US009539845B2

(12) United States Patent
Reusch

(10) Patent No.: US 9,539,845 B2
(45) Date of Patent: Jan. 10, 2017

(54) METHOD AND APPARATUS FOR MAKING SPIRAL-BOUND BOOKS

(71) Applicant: BIELOMATIK LEUZE GMBH + CO. KG, Neuffen (DE)

(72) Inventor: Dirk Reusch, Riederich (DE)

(73) Assignee: bielomatik Leuze GmbH & Co. KG, Neuffen (DE)

( * ) Notice: Subject to any disclaimer, the term of this patent is extended or adjusted under 35 U.S.C. 154(b) by 271 days.

(21) Appl. No.: 14/394,086

(22) PCT Filed: Mar. 25, 2013

(86) PCT No.: PCT/EP2013/056254
§ 371 (c)(1),
(2) Date: Oct. 28, 2014

(87) PCT Pub. No.: WO2013/164142
PCT Pub. Date: Nov. 7, 2013

(65) Prior Publication Data

US 2015/0086296 A1 Mar. 26, 2015

(30) Foreign Application Priority Data

May 2, 2012 (DE) ..... 10 2012 207 295

(51) Int. Cl.
*B42B 4/00* (2006.01)
*B65H 29/68* (2006.01)
(Continued)

(52) U.S. Cl.
CPC ..... *B42B 4/00* (2013.01); *B65H 29/68* (2013.01); *B65H 31/3027* (2013.01);
(Continued)

(58) Field of Classification Search
CPC ..... B42B 4/00; B42B 5/123; B42B 5/12; B65H 29/68; B65H 31/3027; B65H 39/10
(Continued)

(56) References Cited

U.S. PATENT DOCUMENTS 3,555,587 A * 1/1971 Seaborn ..... B42B 5/103 226/43
3,839,759 A * 10/1974 Staats ..... B42B 5/00 402/19
(Continued)

FOREIGN PATENT DOCUMENTS

GB 799727 A 8/1958

*Primary Examiner* — Patrick Mackey
(74) *Attorney, Agent, or Firm* — Andrew Wilford

(57) ABSTRACT

The invention relates to the production of books with wire or spiral bindings or other comparable bindings, wherein sub-layers (2) made of punched sheets are collected one over the other in a successive manner into a book (5) at a collecting station (3), and the book is subsequently bound. According to the invention, a sub-layer (2) is held in a clamped manner by at least one lateral clamping device (12) which moves together with the sub-layer while the sub-layer is transported into the collecting position, while the sub-layers (10) already collected at the collecting station (3) are held in a fixed manner by means of at least one needle (13) which is moved upwards through the punched holes (4) from below. The clamping of the pliers is released only when the needles (13) are also located in the punched holes (4) of the newly conveyed sub-layers (2) as a result of the needles being moved upwards.

9 Claims, 3 Drawing Sheets

Figure 1:
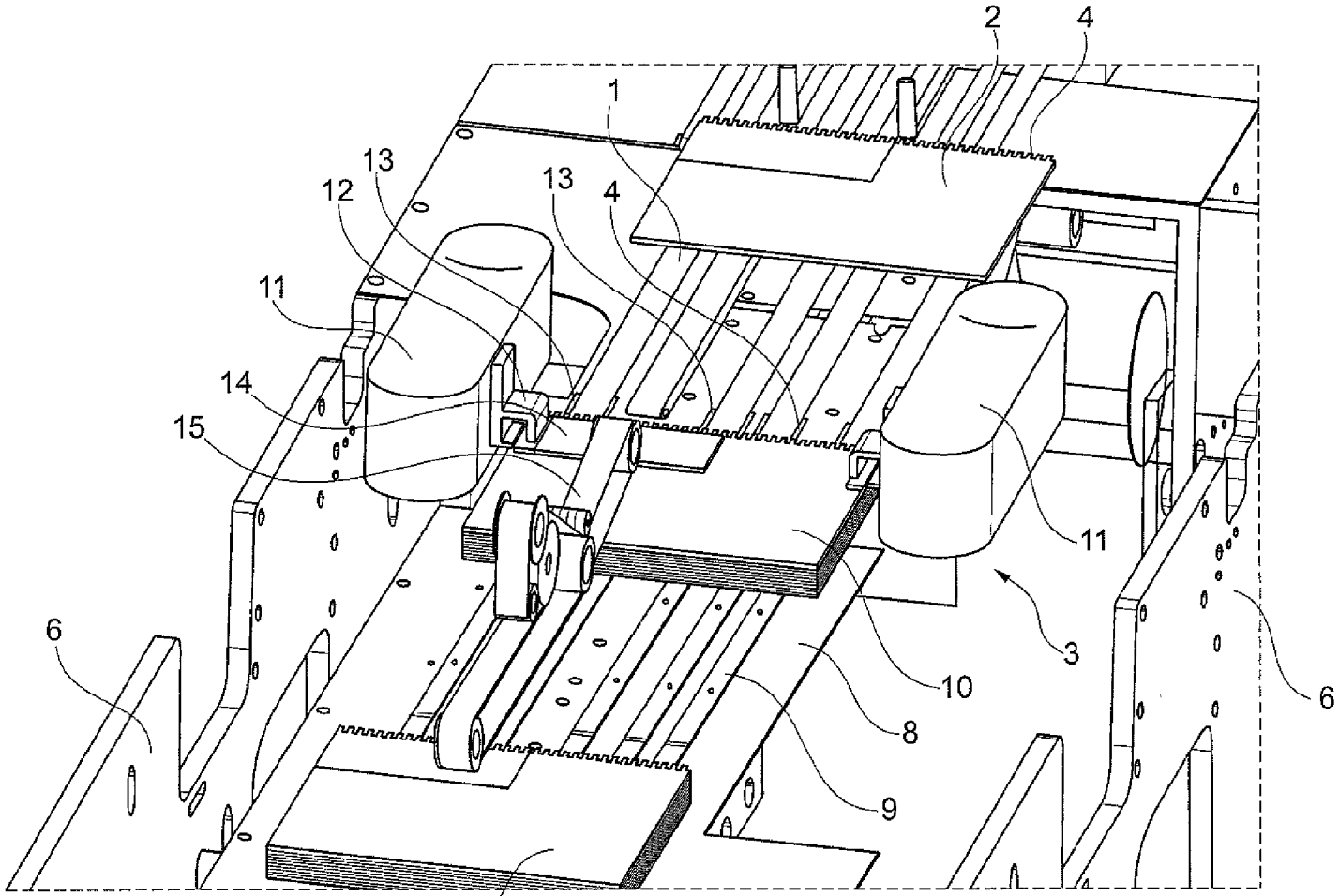

(51) Int. Cl.

| | |
|---|---|
| ***B65H 31/30*** | (2006.01) |
| ***B65H 39/10*** | (2006.01) |
| *B42B 5/08* | (2006.01) |
| *B42C 1/12* | (2006.01) |

(52) U.S. Cl.
CPC ..... *B65H 39/10* (2013.01); *B42B 5/08* (2013.01); *B42C 1/12* (2013.01); *B65H 2301/4381* (2013.01); *B65H 2405/60* (2013.01); *B65H 2701/1212* (2013.01); *B65H 2701/12112* (2013.01); *B65H 2801/48* (2013.01)

(58) Field of Classification Search
USPC ..... 270/52.18
See application file for complete search history.

(56) References Cited

U.S. PATENT DOCUMENTS

| | | | | | |
|---|---|---|---|---|---|
| 3,889,309 | A * | 6/1975 | Adams | B42B 5/103 | 270/58.08 |
| 4,141,099 | A | 2/1979 | Negro | | |
| 4,237,568 | A * | 12/1980 | Kunzmann | B42B 5/08 | 140/92.3 |
| 4,320,547 | A | 3/1982 | Stolle | | |
| 4,610,590 | A * | 9/1986 | Pigna | B42B 5/123 | 412/11 |
| 5,174,557 | A * | 12/1992 | Meier | B42B 4/00 | 270/37 |
| 6,056,495 | A * | 5/2000 | Doyle | B42B 5/123 | 412/38 |
| 6,447,231 | B1 | 9/2002 | Omahony | | |
| 2010/0239391 | A1 * | 9/2010 | Sasaki | B42B 5/103 | 412/6 |

* cited by examiner

METHOD AND APPARATUS FOR MAKING SPIRAL-BOUND BOOKS

CROSS REFERENCE TO RELATED APPLICATIONS

This application is the US-national stage of PCT application PCT/EP2013/05624 filed 23 Mar. 2013 and claiming the priority of German patent application 102012207295.0 itself filed 2 May 2012.

The invention relates to a method of and apparatus for making books with a wire-comb or spiral binding or other comparable bindings, in the case of which partial stacks made up of punched sheets are successively collected one above the other in a collecting location to form a book that is then bound.

For making writing blocks, exercise books, calendars or other kinds of book, it is known for the books to be assembled from partial stacks that have previously been provided on one side with a row of punched holes. For the purpose of binding the books, a wire comb or a spiral is guided through the punched holes. Such a method and such an apparatus are described in DE 26 20 688 [U.S. Pat. No. 4,141,099].

It is usually the case, during the collecting operation, that the partial stacks of a book are moved against a stop in order for the edges to be aligned. The stacks thus aligned are then conveyed for binding.

As far as the configuration of a book is concerned, it is often desired to bind in a cover or interleaved sheets that project on three sides relative to other partial stacks. This means that it is possible only relatively slowly, and with high outlay, for the partial stacks to be aligned on a vertical stop, during the collecting operation, so that they are set down in a precisely positioned manner. The layers can be aligned only by way of a stop on the rear edge (book spine, punched side), and for this purpose the punched side must be at the front in the direction of movement. This makes it necessary for the layer to be subjected to a high-outlay turning operation prior to binding.

It is therefore an object of the invention to create a method and an apparatus of the type in question that make it possible at high speed and with less outlay for books with covers or interleaved sheets that project on three sides to be collected in a precisely positioned manner.

This object is achieved according to the invention in that a partial stack, during transportation into the collecting position, is retained in a gripped state by lateral grippers travelling along with it, whereas the partial stacks that have already been collected in the shaft are retained in a fixed state by two needles moved upward from beneath through the punched holes. The gripping is released only when the needles have been moved further upward through the newly supplied partial stack, until the needle end at least terminates with or even extends beyond the uppermost sheet of the new partial stack.

The operation of transporting a partial stack up into the collecting location and that of transporting the book away out of the collecting location preferably take place with the partial stack and the book on respective conveyor belts. During the operation of transporting a book away out of the collecting location, the book is additionally retained in a fixed state, during acceleration, by an accompanying gripping belt resting on it.

The lateral grippers that grip a partial stack, preferably execute a horizontal movement from the position in which they receive a partial stack until they reach the collecting location. This can be done by a circulating or back-and-forth movement of a traction means, for example of a toothed belt, on which one or more grippers are fastened. The grippers here, in the receiving position, are accelerated to the speed at which the sub-stack is transported up, and then retain the partial stack in a gripped state until full braking has taken place at the collecting location.

The grippers are advantageously configured such that a partial stack is gripped tightly, irrespective of thickness, by spring force. At the point of standstill in the end position at the stacking position, the closed gripper is opened mechanically via a lever to the extent where it latches in of its own accord in the open state by an integrated catch. This position is self-locking on account of the form-fitting configuration. This design has the advantage that there is no need to apply, during transportation, any external additional gripping force for the gripper.

The invention will be explained in more detail hereinbelow with reference to a simplified illustrated embodiment.

Figure 2:
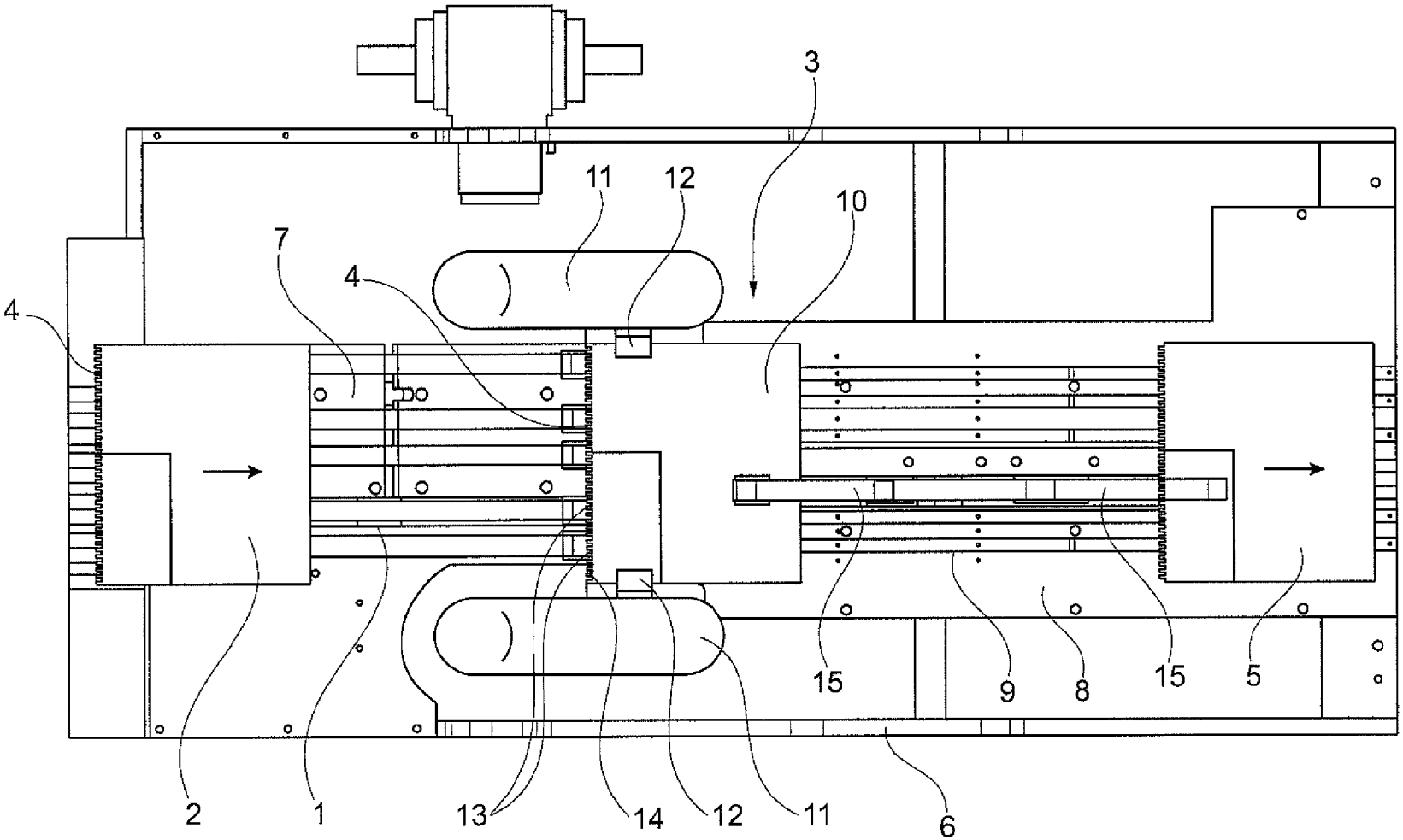
Figure 3:
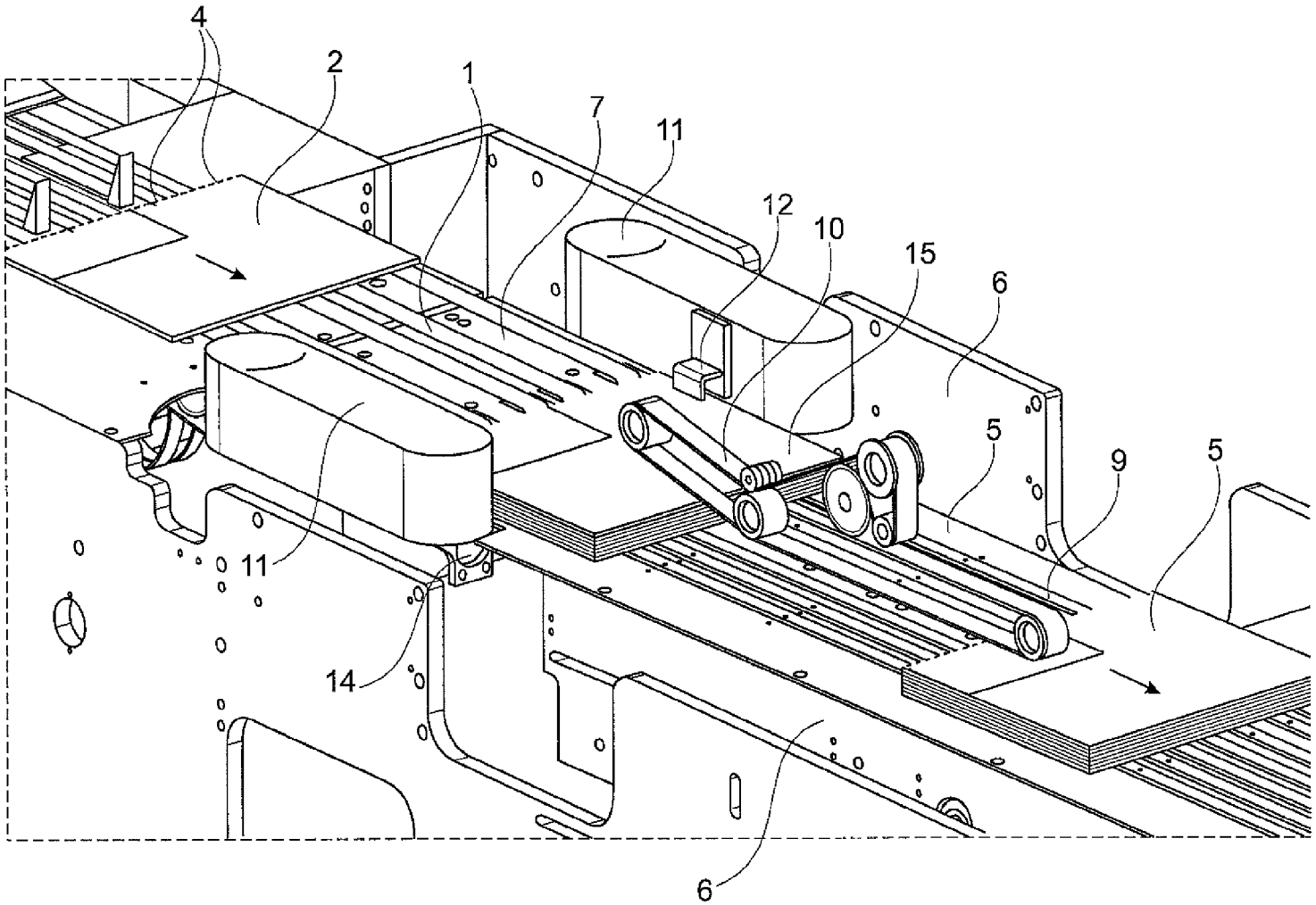

In the drawings:

FIG. 1 shows an oblique view from above counter to the conveying direction of the partial stacks, FIG. 2 shows a plan view of the region of the collecting location, and FIG. 3 shows a further oblique view.

The apparatus partly illustrated in the figures belongs to an installation in which paper rolls are used to produce books bound with wire combs or spirals. In the installation, individual sheets are produced by being cut transversally and longitudinally from paper webs, the sheets then being collected to form partial stacks and provided, by punching, with a row of holes, through which the spirals or wire combs can be guided.

The partial stacks are separated from one another by interleaved sheets positioned thereon and are then collected to form a book, a book cover and a book spine having been fed in addition. The partial stacks that are collected in a precisely positioned manner to form a book, are then bound by spirals or wire combs being guided through the punched holes in a known manner in a binding drum.

FIGS. 1 to 3 illustrate the collecting location 3, in which the partial stacks 2 transported up on conveyor belts 1 are collected to form a book 5. The sheets of a partial stack 2 have on their rear side, as seen in the transporting direction, a row of punched holes 4, through which a spiral or a wire comb is guided during the operation of binding the book 5. In order to allow for this, the punched holes 4 of the sheets located one above the other have to be congruent; therefore, the partial stacks 2 are conveyed with appropriately positioned sheets to the collecting location 3.

As illustrated in FIG. 1, the framework 6 of the apparatus has arranged in it, in front of the connecting location 3, a horizontal tabletop 7, on the surfaces of which move conveyor belts 1 for the purpose of transporting up partial stacks, partial stacks 2 and the books 5 being transported by the conveyor belts 1 in a state in which they rest thereon. At the start of the collecting location 3 is the beginning of a further tabletop 8 that has conveyor belts 9 and can be pivoted downward at the collecting location 3 in order to form a set-down step relative to the tabletop 7. As an alternative, the tabletop may be offset some way downward relative to the belts 1 that supply the partial stacks 2. The step that is formed by the pivoting-down action or the offset arrangement makes it possible for the partial stacks 2 to be set down, by the conveyor belts 1, on the upper side of the already collected partial stacks 10.

A toothed belt 11, which can be moved in circulation parallel to the conveyor belt 1 by a drive, is arranged on each longitudinal side of the apparatus, wherein at least one toothed belt 11 carries, preferably both toothed belts 11 carry, a gripper 12, as clamp, on the side directed toward the collecting location 3. The toothed belts 11 are configured such that the gripper 12 can be displaced into the region of the stacking location 3 out of a region in front of the stacking location 3. By the drives (not illustrated), the grippers 12 can be accelerated to the conveying speed of the conveyor belts 1 and then braked to a standstill en route to the stacking location 3. As an alternative, it is also possible to use back-and-forth toothed belts or else other traction means, such as chains, in order to move the grippers to the stacking location 3. It is thus possible for a partial stack 2 to be received by the grippers 12 at the transporting speed of the sheets 7, and then the partial stack is braked and set down in a precisely positioned manner at the collecting location 3. The corresponding movement of the toothed belts 11 takes place preferably via servomotors; as an alternative, it is also possible to use mechanically driven stepping gear mechanisms.

The grippers 12 are configured such that a partial stack 2 is gripped tightly, irrespective of thickness, by spring force. At the point of standstill in the end position of the stacking location 3, the closed gripper 12 is opened mechanically via a lever to the extent where it latches in of its own accord in the open state by an integrated catch. This position is self-locking on account of the form-fitting configuration. This design has the advantage that there is no need to apply, during transportation, any external additional gripping force for the gripper 12. The toothed belt 11 merely has the task of moving the gripper 12 in accordance with the predetermined travelling profile. Once the open gripper 12 has been accelerated, in its starting position, to a speed synchronous with the incoming partial stack 2, it is closed by a cam that is firmly screwed on in the framework 6. For this purpose, the latter opens the catch, in order for the gripper 12 to close by the spring compressing it. The region in which the grippers 12 are moved at synchronous speed is selected such that different conveying speeds of the partial stacks 2 do not have any influence on the positioning precision.

The stacking location 3 has fastened beneath it at least one needle 13, preferably two or more needles 13, extending upward on a cross member 14. The cross member 14 with the needles 13 can be moved, by a lift actuator, vertically upward into the region of the table surface 8 and, at the same time, can be lowered to the extent where the points of the needles 13 are located beneath the conveyor belts 8. The needles 13 can thus be moved upward through two of the punched holes 4, in order for the partial stacks 10 collected at the collecting location 3 to be retained in a fixed state. The vertical position of the needle points is set such that it is located beneath the entry level of the next partial stack 2 conveyed up and, at the same time, the needles 13 fix the already collected partial stacks securely. It is thus the case that the collected partial stacks 10, as a new partial stack 2 is being transported up, are retained in position without obstructing the operation of the new partial stack 2 being placed in position. Once the new partial stack 2 has been set down in a precisely positioned manner at the stacking location 3, then the needles 13 are raised at least by the thickness of the new partial stack 2, in order to fix the latter in a precisely positioned manner at the stacking location 3. They then extend through the corresponding punched holes 4 of the newly collected partial stack 10. It is only then that the grippers 12 are opened and are moved round or back into the receiving position in front of the stacking location 3, in order to receive a new partial stack 2.

When all the partial stacks 10 of a book 5 have been collected at the collecting location 3, then an upper gripping belt 15 is placed in position on the upper side. The book 5 is then accelerated by the conveyor belts 9, with the accompanying gripping belt 15 resting on it, and retained in a fixed state in the process in order to be fed to the subsequent binding station. The operation of binding a book 5 takes place, in a known manner, using a spiral or a wire comb that are guided through the punched holes 4.

The invention claimed is:

1. A method of making books with a wire-comb or spiral binding or other comparable bindings where partial stacks made up of sheets through which holes are punched are successively collected one above the other at a collecting location to form a book that is then bound, the method comprising the steps of:

gripping each partial stack, during transportation into the collecting position, with at least one lateral gripper traveling along with it;

holding the partial stacks collected at the collecting location stationary by at least one needle moved upward from beneath through the punched holes; and releasing each gripper only when the needles, as a result of being moved upward, are also engaged in the punched holes of the newly supplied partial stack.

2. The method as claimed in claim 1, wherein the operation of transporting the partial stack up to the collecting location, and that of transporting the book away from the collecting location, take place with the partial stack and the book on respective conveyor belts.

3. The method as claimed in claim 2, wherein, during the operation of transporting a book downstream out of the collecting location, the book is retained stationary by an accompanying gripping belt resting on it.

4. The method as claimed in claim 1, wherein at least one lateral gripper is moved between a position in which it receives a partial stack and the collecting location.

5. An apparatus for method making books from partial stacks of sheets through which holes have been punched, the apparatus comprising:

a conveyor belt extending in a travel direction and along a travel path to a collecting location;

a removal conveyor belt extending downstream out of the collecting location;

at least one upwardly projecting needle at the collecting location a lift actuator for upwardly moving a point of the needle to above the conveyor belts;

at least one gripper movable in the travel direction laterally along the path into the stacking location from upstream of the stacking location; and control means for operating the gripper and the actuator to grip and move one of the partial stacks, into the stacking location and hold the grip stationary while the needle is poked upward through the partial stack.

6. The apparatus as claimed in claim 5, wherein a horizontally movable gripper is arranged on each longitudinal side of the travel path along which the partial stacks are conveyed to the stacking location.

7. The apparatus as claimed in claim 5, wherein the gripper can be accelerated to a speed synchronous with that of the supplying conveyor belt and can be braked to a standstill en route to the stacking location.

8. The apparatus as claimed in claim 5, further comprising:

gripping belts that can be positioned from above on a book of which all of the constituent parts have been collected together and extending downstream in the transporting direction from the region of the stacking location, in order for a finished book to be retained in the fixed state as it is accelerated out of the stacking location together with the removal conveyor belt.

9. The apparatus as claimed in claim 5, wherein the grippers are configured such that a partial stack is gripped tightly, irrespective of thickness, by spring force, each gripper having latch means that, at the point of standstill in an end position at the stacking location, the closed gripper can be opened mechanically via a lever to the extent where it latches in of its own accord in the open state.

* * * * *